US009162843B2

(12) United States Patent
Yu Chen

(10) Patent No.: US 9,162,843 B2
(45) Date of Patent: Oct. 20, 2015

(54) ADHESIVE TAPE CUTTING DEVICE

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 302 days.

(21) Appl. No.: 13/965,331

(22) Filed: Aug. 13, 2013

(65) Prior Publication Data

US 2015/0048136 A1 Feb. 19, 2015

(51) Int. Cl.
*B65H 35/07* (2006.01)
*B65H 35/00* (2006.01)

(52) U.S. Cl.
CPC ..... *B65H 35/0073* (2013.01); *B65H 35/006* (2013.01); *B65H 2407/10* (2013.01); *Y10T 225/285* (2015.04)

(58) Field of Classification Search
CPC ..... B65H 35/00; B65H 35/0006; B65H 35/0013; B65H 35/002; B65H 35/0026; B65H 35/0033; B65H 35/0073; B65H 35/008; B65H 35/04; B65H 35/06; Y10T 225/285; Y10T 225/20; Y10T 225/203; Y10T 225/215; Y10T 225/216; Y10T 225/222; Y10T 225/238; Y10T 225/246; Y10T 225/282; Y10T 225/298
USPC ..... 242/570, 579, 598, 598.5, 598.1
See application file for complete search history.

(56) References Cited

U.S. PATENT DOCUMENTS

| | | | | |
|---|---|---|---|---|
| 6,789,594 | B1 * | 9/2004 | Yu Chen | 156/523 |
| 7,950,435 | B2 * | 5/2011 | Lee | 156/527 |
| 2006/0213623 | A1 * | 9/2006 | Yu Chen | 156/584 |
| 2007/0012743 | A1 * | 1/2007 | Yu Chen | 225/19 |
| 2012/0006932 | A1 * | 1/2012 | Chang | 242/598 |
| 2012/0305617 | A1 * | 12/2012 | Kuehn et al. | 225/39 |
| 2014/0263525 | A1 * | 9/2014 | Chen | 225/17 |

* cited by examiner

*Primary Examiner* — Phong Nguyen
(74) *Attorney, Agent, or Firm* — Ming Chow; Sinorica, LLC

(57) ABSTRACT

A portable adhesive tape cutting device includes a main body, a cutting unit fixedly on the main body, a handle pivotally connected to two side walls of the main body, and a cover pivotally connected to the handle. The present invention can be used quickly and conveniently for cutting a desired length of adhesive tape. The portable adhesive tape cutting device is provided with the handle for the user to change the position of the portable adhesive tape cutting device conveniently.

10 Claims, 8 Drawing Sheets

ADHESIVE TAPE CUTTING DEVICE

BACKGROUND OF THE INVENTION

1. Field of the Invention

The present invention relates to an adhesive tape cutting device, and more particular to a portable adhesive tape cutting device.

2. Description of the Prior Art

As shown in FIG. 1, a conventional adhesive tape cutting device comprises a base 1. A rotatable wheel 3 is pivotally provided in a recess 2 of the base 1. A roll of adhesive tap 4 is fitted on the rotatable wheel 3. A blade seat 5 with a blade 6 is provided at the front end of the base 1. When in use, the adhesive tape is cut by the blade 6. After cutting, the front end of the roll of adhesive tape is adhered on the blade 6 for next use. There is no need to find out the front edge of the roll of adhesive tape every time.

However, when the user wants to change the position of the conventional adhesive tape cutting device, he/she must hold the two sides or the bottom of the base 1 with both hands. The surface of the base 1 is smooth. Sometimes, the adhesive tape cutting device may fall out of the user's hands by accident. Furthermore, during use, the adhesive tape cutting device may slide because of applying an improper force. It is necessary to adjust the position of the adhesive tape cutting device again, so it is difficult to change the position of the adhesive tape cutting device. Besides, the blade 6 protrudes out of the adhesive tape cutting device. It may hurt the user when in use. The roll of adhesive tape will lessen during use to change the angle of the adhesive tape to extend out, which causes that the roll of adhesive tape cannot be adhered certainly. Accordingly, the inventor of the present invention has devoted himself based on his many years of practical experiences to solve these problems.

SUMMARY OF THE INVENTION

The primary object of the present invention is to provide a portable adhesive tape cutting device which can be used quickly and conveniently for cutting a desired length of adhesive tape and can be moved stably for the user to change the position of the portable adhesive tape cutting device conveniently.

In order to achieve the aforesaid object, the portable adhesive tape cutting device comprises a main body, a cutting unit, a rotatable wheel, a handle and a cover. The main body has a pair of fixing portions extending upward from two sides of a frond end thereof. The side wall edges of the pair of fixing portions are integrally formed with a pair of positioning blocks. The main body has two side walls at two sides thereof. The two side walls of the main body each have a groove at a predetermined position of an edge thereof. The main body comprises at least one stop member at a predetermined position of the two side walls. The cutting unit has a blade and a holding plate. The lower end of the holding plate is a vertical plate body. The upper end of the plate body is transversely bent to form a curved holding portion. The blade and the holding plate are fixed to the positioning blocks. The rotatable wheel has a central axle corresponding to the grooves of the two side walls of the main body. The central axle is mounted in the grooves. The handle has two side walls at two sides thereof. The two side walls of the handle are pivotally connected to the two side walls of the main body, respectively. The handle is pivotally connected with an engaging member corresponding to the stop member. The cover is pivotally connected to the handle. The front end of the cover has a pair of engaging portions corresponding to the pair of fixing portions.

When the portable adhesive tape cutting device is used, a roll of adhesive tape is fitted on the rotatable wheel, and then a desired length of the adhesive tape is pulled out to be cut by the blade. After cutting, the front end of the remaining adhesive tape is adhered on the holding plate for next use. The angle of the adhesive tape to extend out won't be changed when the roll of adhesive tape lessens after use. The present invention can be used quickly and conveniently for cutting a desired length of the adhesive tape. The portable adhesive tape cutting device is provided with the handle for the user to change the position of the portable adhesive tape cutting device conveniently.

DETAILED DESCRIPTION OF THE PREFERRED EMBODIMENTS

Embodiments of the present invention will now be described, by way of example only, with reference to the accompanying drawings.

Figure 1:
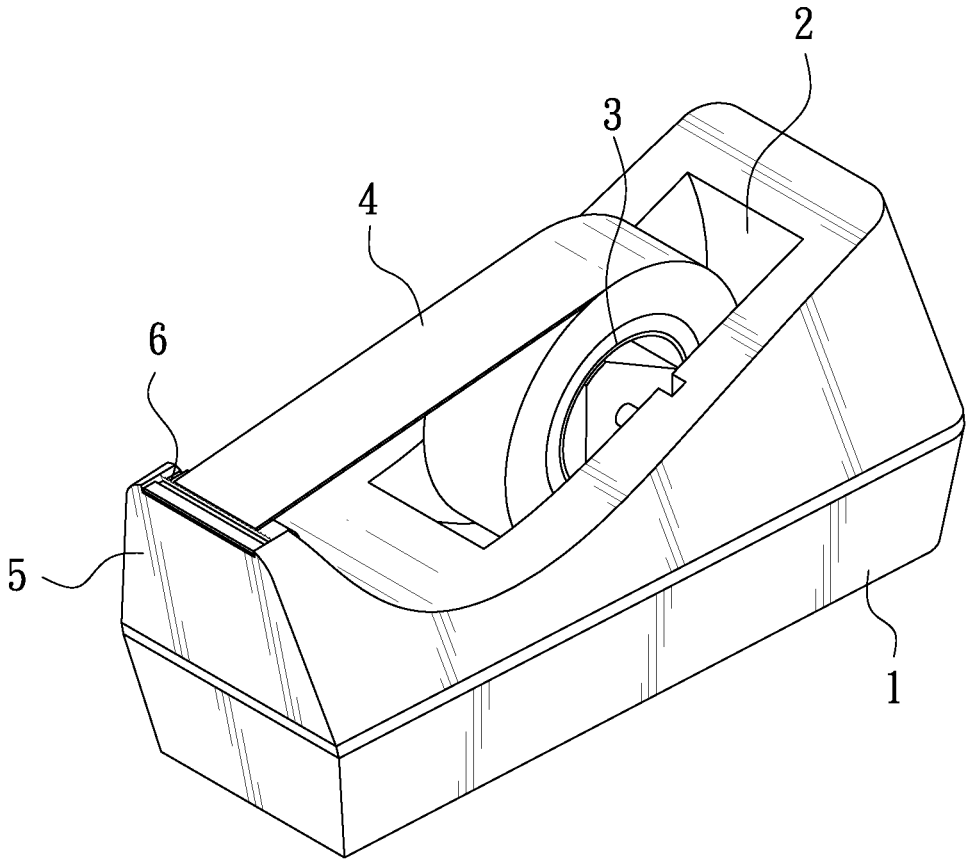
FIG. 1 PRIOR ART
FIG. 1 is a perspective view of a conventional adhesive tape cutting device.
Figure 2:
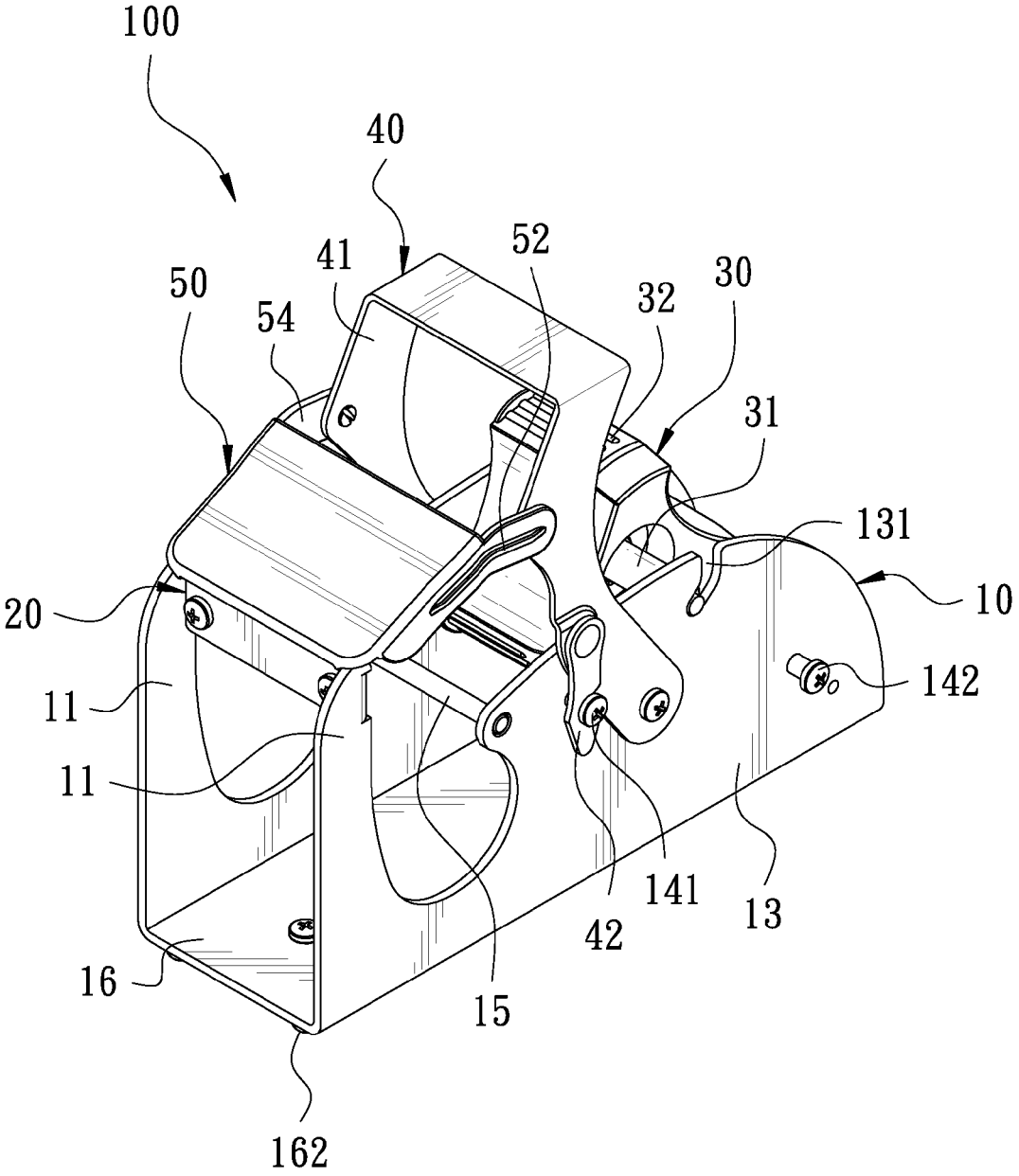
FIG. 2 is a perspective view according to a preferred embodiment of the present invention.
Figure 3:
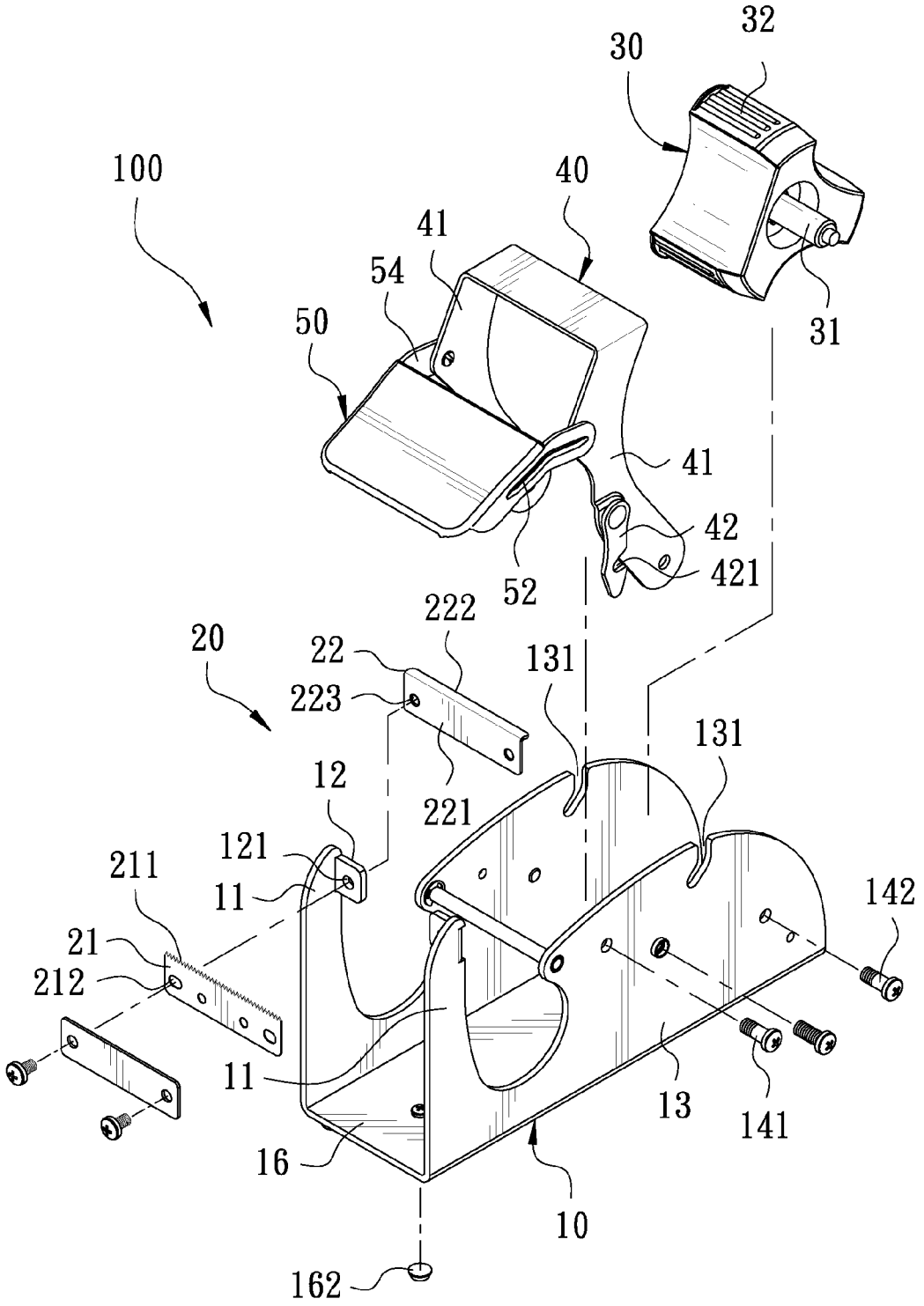
FIG. 3 is an exploded view according to the preferred embodiment of the present invention.
Figure 4:
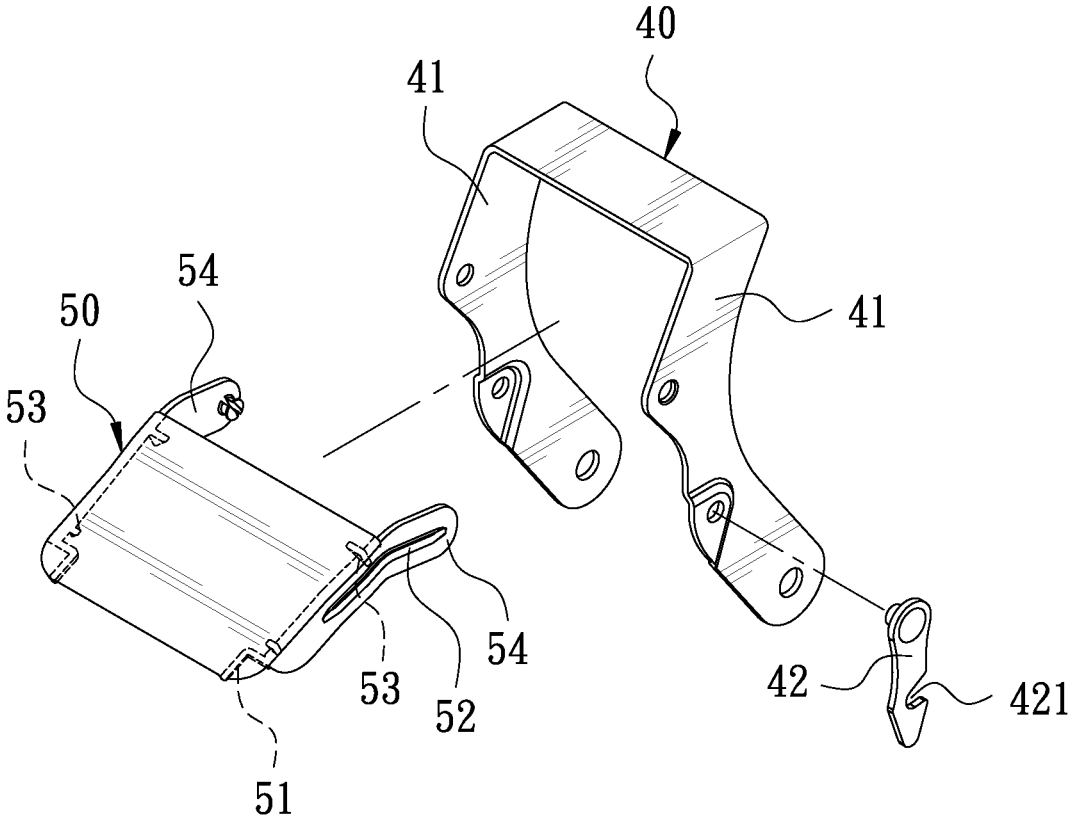
FIG. 4 is a partially exploded view according to the preferred embodiment of the present invention.
Figure 5:
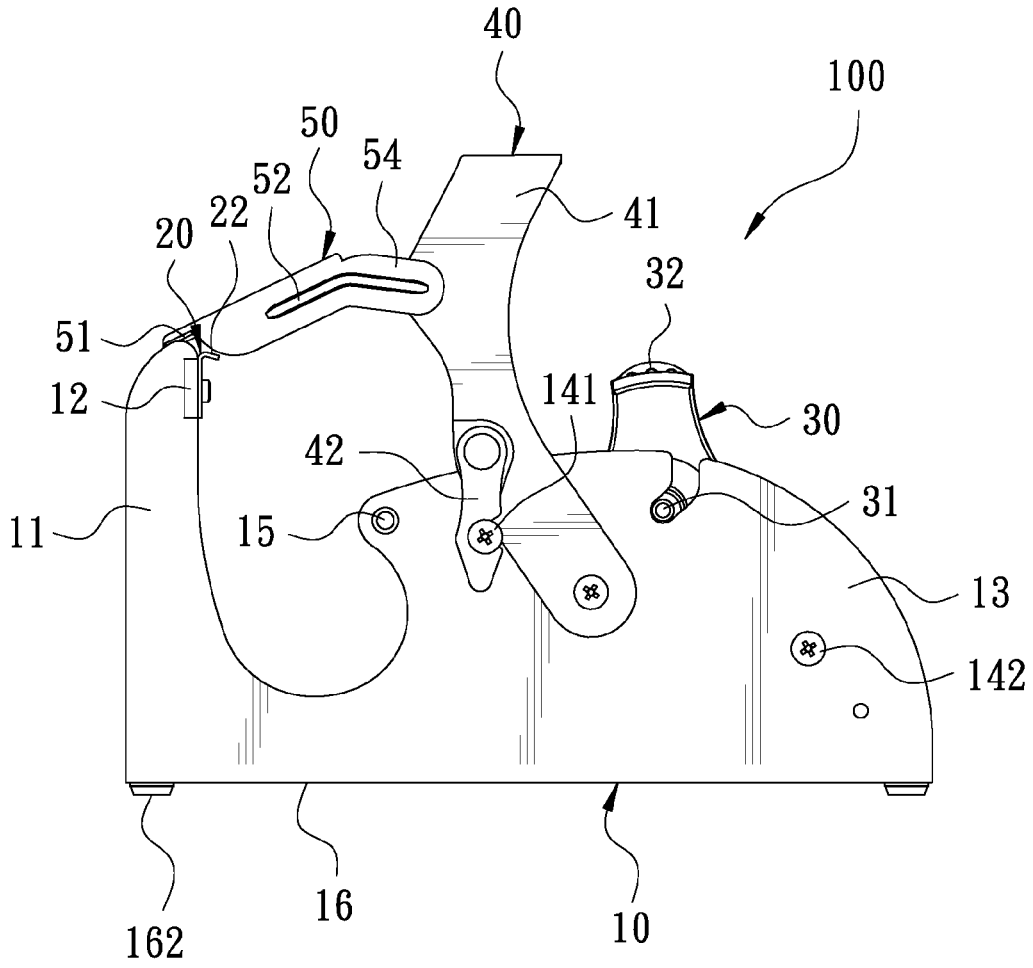
FIG. 5 is a side view according to the preferred embodiment of the present invention.

FIG. 2 is a perspective view according to a preferred embodiment of the present invention. FIG. 3 is an exploded view according to the preferred embodiment of the present invention. FIG. 4 is a partially exploded view according to the preferred embodiment of the present invention. FIG. 5 is a side view according to the preferred embodiment of the present invention. The present invention discloses a portable adhesive tape cutting device 100. The portable adhesive tape cutting device 100 comprises a main body 10, a cutting unit 20, a rotatable wheel 30, a handle 40, and a cover 50.

Figure 7:
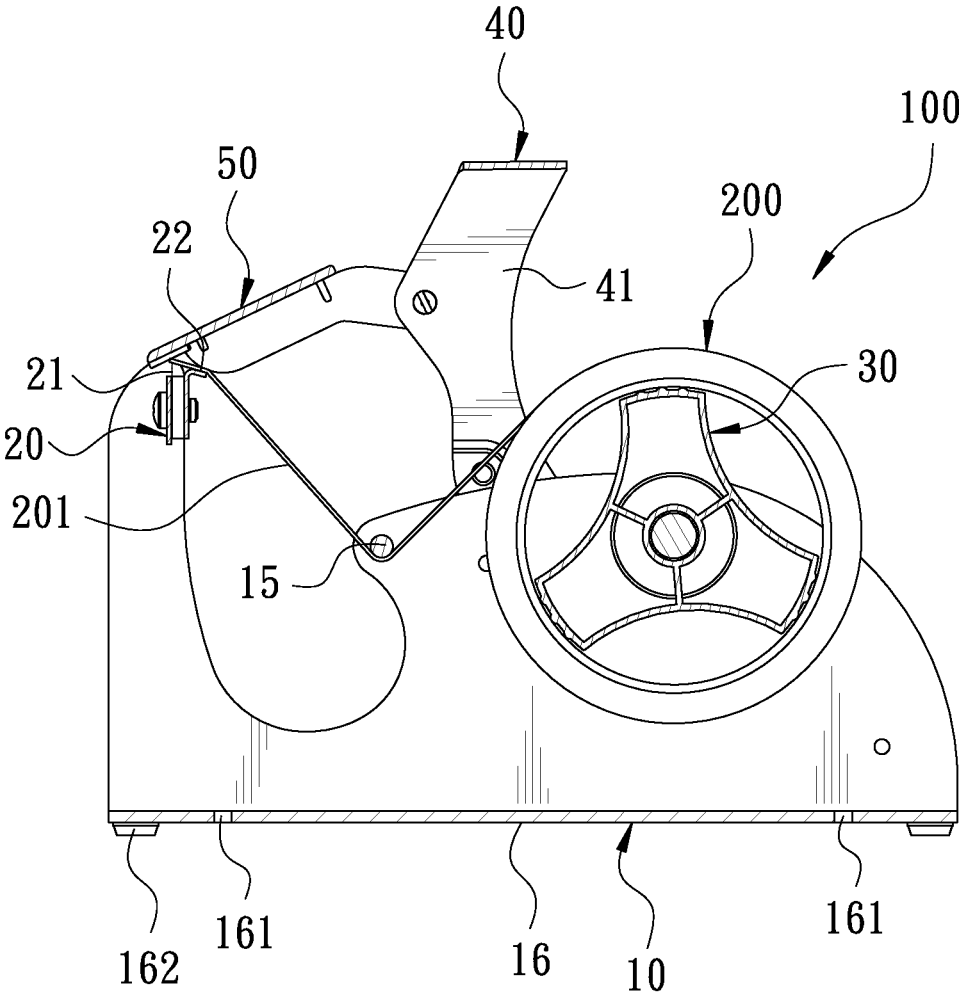
FIG. 7 is a side view of the preferred embodiment of the present invention when in use.

The main body 10 is formed by bending a metallic plate and has a U-shaped cross-section. The main body 10 has a pair of fixing portions 11 extending upward from two sides of a frond end thereof. The side wall edges of the pair of fixing portions 11 are integrally formed with a pair of positioning blocks 12. The positioning blocks 12 each have a first through hole 121. The main body 10 has two side walls 13 at two sides thereof. The two side walls 13 of the main body 10 each have a groove 131 at a predetermined position of an edge thereof. The main body 10 comprises two stop members 14 at a predetermined position of the two side walls 13. The two stop members 14 respectively define a first stop member 141 and a second stop member 142. The main body 10 further comprises a non-return rod 15 between the two side walls 13. Two ends of the non-return rod 15 are respectively connected to the two side walls 13 of the main body 10. The main body 10 has a bottom wall 16 formed with a plurality of threaded through holes 161, as shown in FIG. 7. The bottom side of the bottom wall 16 is provided with a plurality of elastic blocks 162.

The cutting unit 20 has a blade 21 and a holding plate 22. The blade 21 has a serrate blade tooth at an upper edge thereof. The lower end of the holding plate 22 is a vertical plate body 221. The upper end of the plate body 221 is transversely bent to form a curved holding portion 222. The blade 21 and the holding plate 22 respectively have second through holes 212, 223 corresponding in position to the first through holes 121 of the positioning blocks 12 for insertion of bolts so as to fix the blade 21 and the holding plate 22 to the main body 10.

The rotatable wheel 30 has a central axle 31 corresponding to the grooves 131 of the side walls 13 of the main body 10. The central axle 31 is mounted in the grooves 131 so that the rotatable wheel 30 is rotatable on the main body 10. The rotatable wheel 30 has a plurality of ribs 32 on a circumferential surface thereof for mounting at least one roll of adhesive tape.

The handle 40 is formed by bending a metallic plate and has a U-shaped cross-section. The handle 40 has two side walls 41 at two sides thereof. The two side walls 41 of the handle 40 are pivotally connected to the two side walls 13 of the main body 10, respectively. The two stop members 14 are disposed at two opposing sides of the two side walls 41 of the handle 40, respectively. The handle 40 is pivotally connected with an engaging member 42 corresponding to the stop member 14. The engaging member 42 has an engaging recess 421 corresponding to the stop member 14.

The cover 50 is made of a transparent material. The cover 50 is pivotally connected to a predetermined position of the two side walls 41 of the handle 40. The front end of the cover 50 has a pair of engaging portions 51 corresponding to the pair of fixing portions 11. The engaging portions 51 are L-shaped protrusions. The cover 50 has a pair of protruding ribs 52 extending from two sides thereof. The cover 50 has a plurality of reinforcement ribs 53 therein. In this embodiment, the cover 50 is integrally formed with a pair of extension walls 54 corresponding to the two side walls 41 of the handle 40. The extension walls 54 are pivotally connected to the two side walls of the handle 40, respectively.

Figure 6:
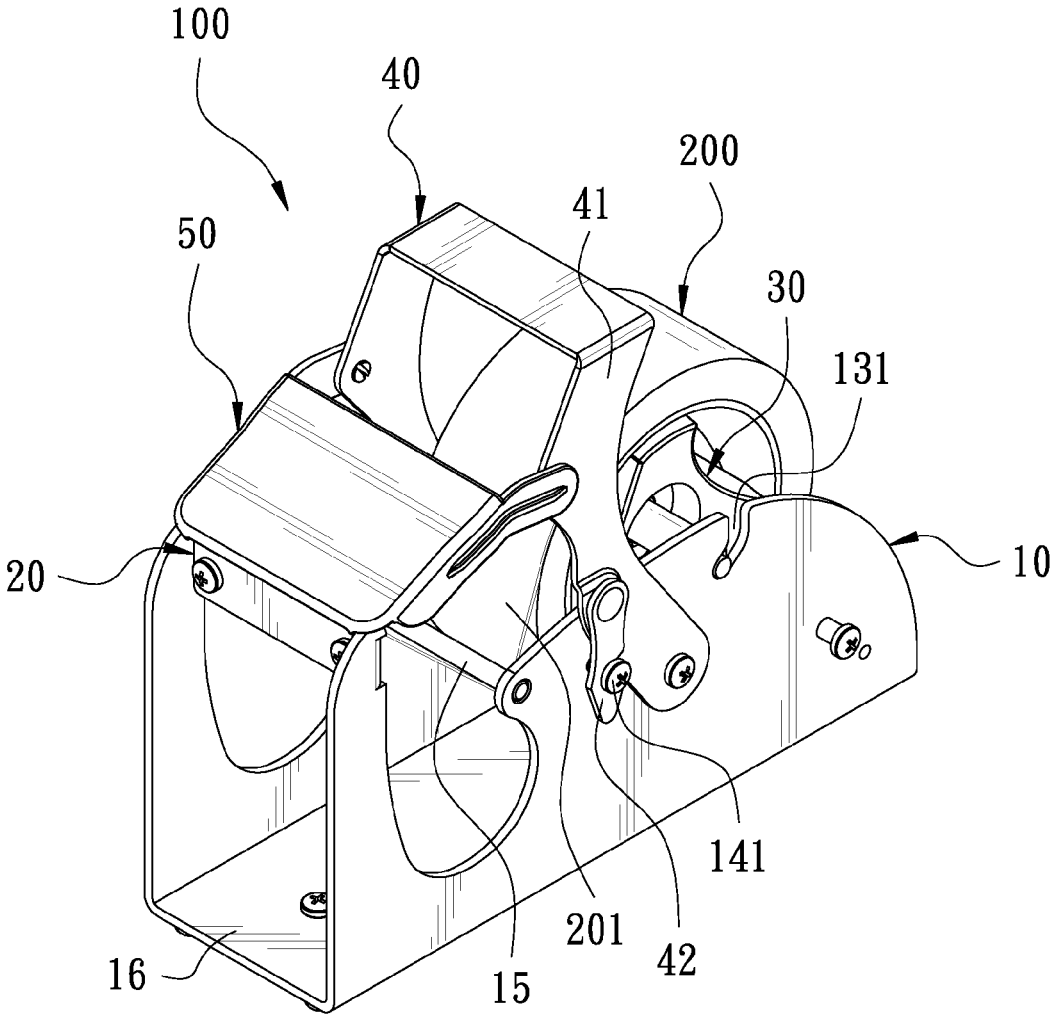
FIG. 6 is a perspective view of the preferred embodiment of the present invention when in use.

FIG. 6 is a perspective view of the preferred embodiment of the present invention when in use. FIG. 7 is a side view of the preferred embodiment of the present invention when in use. When the portable adhesive tape cutting device 100 is used, the user makes the edge of the side wall 41 of the handle 40 hold against the first stop member 141 and the engaging member 42 engage with the first stop member 141 so as to fix the handle 40. A roll of adhesive tape 200 is fitted on the rotatable wheel 30, and then the rotatable wheel 30 is mounted in the grooves 131. The adhesive tape 201 is pulled out to pass between the non-return rod 15 and the bottom wall 16 of the main body 10 and then cut through the blade 21. After cutting, the front end of the remaining adhesive tape 201 is adhered on the holding plate 22 for next use. There is no need to find out the front end of the roll of adhesive tape 200 each time.

When the user wants to change the position of the portable adhesive tape cutting device 100, he/she just grasps the handle 40 to move the portable adhesive tape cutting device 100.

Figure 8:
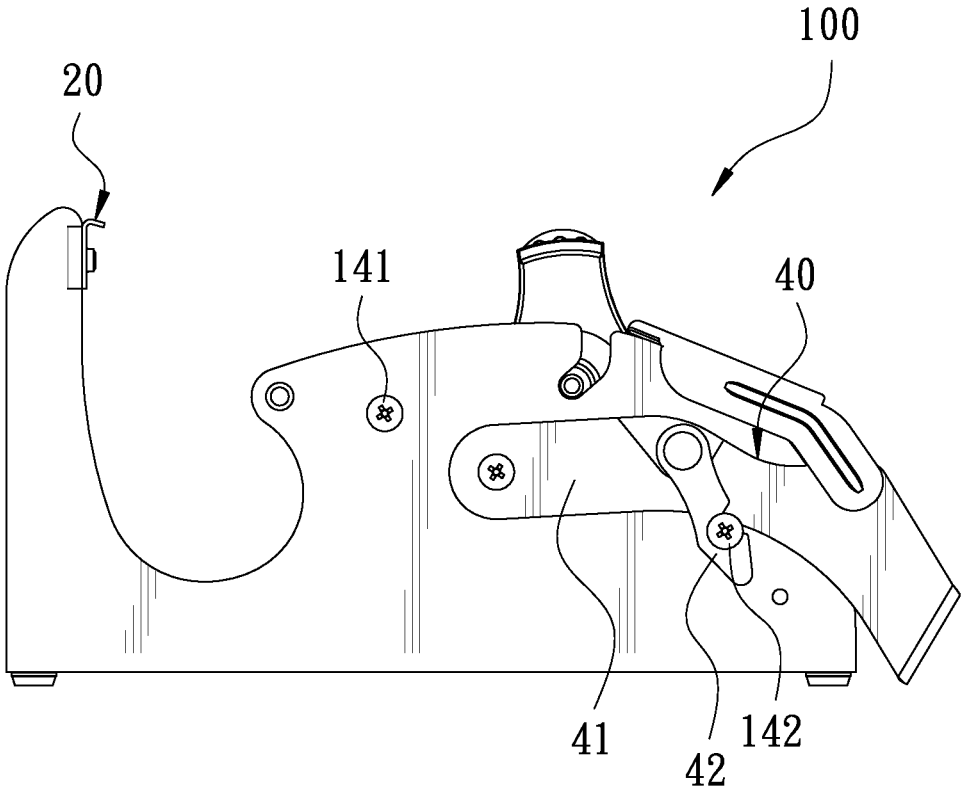
FIG. 8 is a side view of the preferred embodiment of the present invention in a folding state.

When the user wants to decrease the size of the portable adhesive tape cutting device 100, the engaging member 42 is disengaged from the first stop member 141 so that the handle 40 can be turned. After that, the edge of the side wall 41 of the handle 40 is to hold against the second stop member 142 and the engaging member 42 engages with the second stop member 142, as shown in FIG. 8, so as to decrease the size of the portable adhesive tape cutting device 100 for transportation. Wherein, the portable adhesive tape cutting device 100 has the edge of the side wall 41 of the handle 40 to hold against the second stop member 142 and the engaging member 42 to engage with the second stop member 142 to enhance its stability during use and transportation. Thus, the user can make the portable adhesive tape cutting device 100 in an operating or closed state for use or transportation.

It is noted that the front end of the remaining adhesive tape 201 is adhered on the holding plate 22, as shown in FIG. 7. The main body 10 is provided with the non-return rod 15, such that the angle of the adhesive tape 201 to extend out won't be changed when the roll of adhesive tape 200 lessens after use. The adhesive tape 201 is adhered on the holding plate 22 stably. When the roll of adhesive tape 200 is turned reversely, the adhesive tape 201 won't disengage from the holding plate 22. There is no need to find out the front end of the roll of adhesive tape for next use.

It is noted that thee cutting unit 20 is provided with the cover 50. The cover 50 has the engaging portions 51. Through the engaging portions 51 to engage with the fixing portions 11, the cover 50 is stable to cover the cutting unit 20 to prevent the user from touching the blade 21 by accident. This is safe for use. The cover 50 has the protruding ribs 52 for the user to lift the cover 50 to replace or adjust the roll of adhesive tape 200. The cover 50 has the plurality of reinforcement ribs 53 to strengthen the structure of the cover 50.

Furthermore, the portable adhesive tape cutting device 100 can be held on a flat plane through the elastic blocks 162, or screwed to the flat plane with a plurality of bolts inserting through the threaded through holes 161, or stably fixed on the flat plane through both the bolts and the elastic blocks 162. This can prevent the portable adhesive tape cutting device from sliding.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A portable adhesive tape cutting device, comprising:

a main body, the main body having a pair of fixing portions extending upward from two sides of a frond end thereof, side wall edges of the pair of fixing portions being integrally formed with a pair of positioning blocks, the main body having two side walls at two sides thereof, the two side walls of the main body each having a groove at a predetermined position of an edge thereof, the main body comprising at least one stop member at a predetermined position of the two side walls;

a cutting unit, the cutting unit having a blade and a holding plate, a lower end of the holding plate being a vertical plate body, an upper end of the plate body being transversely bent to form a curved holding portion, the blade and the holding plate being fixed to the positioning blocks;

a rotatable wheel, the rotatable wheel having a central axle corresponding to the grooves of the two side walls of the main body, the central axle being mounted in the grooves;

a handle, the handle having two side walls at two sides thereof, the two side walls of the handle being pivotally connected to the two side walls of the main body respectively, the handle being pivotally connected with an engaging member corresponding to the stop member; and a cover, the cover being pivotally connected to the handle, a front end of the cover having a pair of engaging portions corresponding to the pair of fixing portions.

2. The portable adhesive tape cutting device as claimed in claim 1, wherein the main body further comprises a non-return rod between the two side walls thereof, and two ends of the non-return rod are respectively connected to the two side walls of the main body.

3. The portable adhesive tape cutting device as claimed in claim 1, wherein the main body has a bottom wall formed with a plurality of threaded through holes.

4. The portable adhesive tape cutting device as claimed in claim 1, wherein the positioning blocks each have a first through hole, the blade and the holding plate respectively have two second through holes corresponding in position to the first through holes of the positioning blocks for insertion of bolts so as to fix the blade and the holding plate to the positioning blocks.

5. The portable adhesive tape cutting device as claimed in claim 1, wherein the main body comprises two stop members, and the two stop members are disposed at two opposing sides of the two side walls of the handle, respectively.

6. The portable adhesive tape cutting device as claimed in claim 1, wherein the rotatable wheel has a plurality of ribs on a circumferential surface thereof.

7. The portable adhesive tape cutting device as claimed in claim 1, wherein the engaging member has an engaging recess corresponding to the stop member.

8. The portable adhesive tape cutting device as claimed in claim 1, wherein the cover is integrally formed with a pair of extension walls corresponding to the two side walls of the handle, and the extension walls are pivotally connected to the two side walls of the handle, respectively.

9. The portable adhesive tape cutting device as claimed in claim 1, wherein the engaging portions are L-shaped protrusions.

10. The portable adhesive tape cutting device as claimed in claim 1, wherein the cover has a pair of protruding ribs extending from two sides thereof and a plurality of reinforcement ribs therein.

* * * * *